United States Patent [19]

Lary

[11] Patent Number: 4,934,698

[45] Date of Patent: Jun. 19, 1990

[54] SOFT BOWLING BALL

[76] Inventor: Edmund C. Lary, Box 534, Taos, N. Mex. 87571

[21] Appl. No.: 265,570

[22] Filed: Nov. 1, 1988

[51] Int. Cl.[5] ..... A63B 37/06

[52] U.S. Cl. ..... 273/63 R; 273/63 D

[58] Field of Search ..... 273/63 R, 63 D

[56] References Cited

U.S. PATENT DOCUMENTS 3,256,018 6/1966 Baggenstoss ..... 273/63 R

*Primary Examiner*—George J. Marlo

*Attorney, Agent, or Firm*—Eric P. Schellin

[57] ABSTRACT

A bowling ball consisting of an inner core of generally elastomeric material, an outer shell of material generally surrounding throughout all the inner core, and the inner core being of generally elastomeric material generally consisting of material significantly softer than the outer shell of hard surfaced material. Upon impact with a bowling pin, the ball assumes an effectively smaller radius, which results in improved penetration of the strike pocket.

9 Claims, 1 Drawing Sheet

Fig. 1
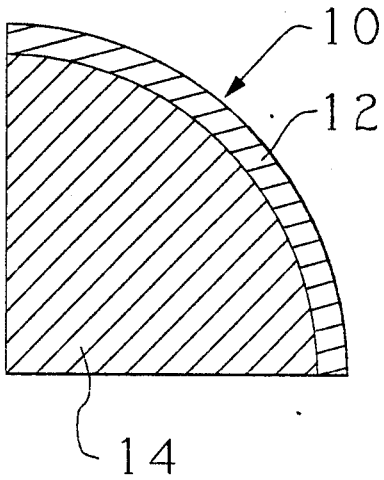
Fig. 2
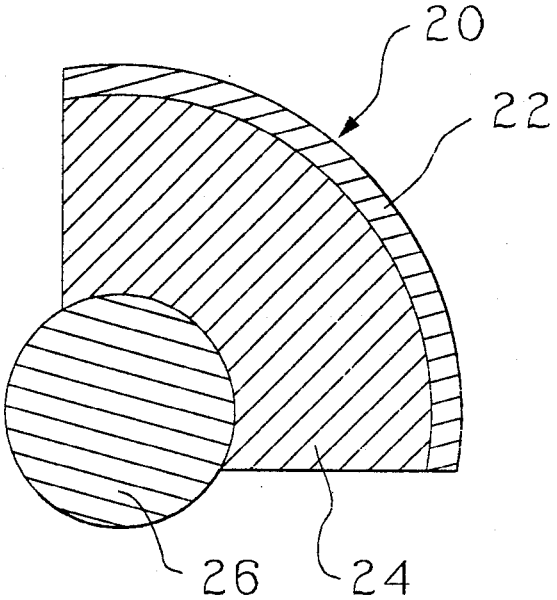
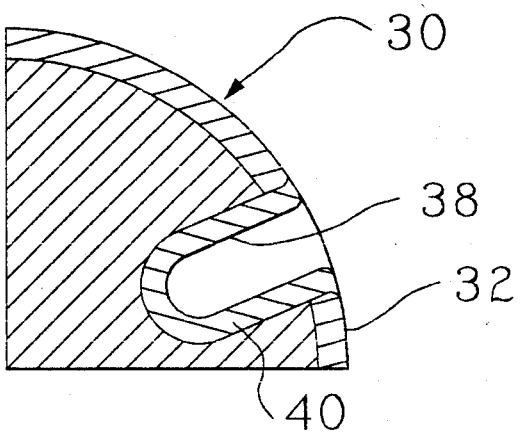
Fig. 3

SOFT BOWLING BALL

BACKGROUND OF THE INVENTION

1. Field of the Invention

The invention relates to structural features of an improved bowling ball having generally a central or inner core of soft elastomeric material softer than the hardness of the material consisting of the pins with which the ball is to impact, and more particularly, the invention is directed to a bowling ball having greater overall deformability, consisting of a hard and thin dimensioned outer shell which is deformable and durable against creasing, yielding and fatigue, which encloses an interior elastomeric material significantly softer than the material of the shell, and than the pins of the game against which the ball is thrown. Ball deformation by the pin at impact affords an effectively smaller ball radius, permitting improved penetration of pinset "strike pocket" for higher scorability.

2. Description of the Prior Art

Various prior art constructions for bowling balls, and the like, as well as apparatus and method of their construction in general, are found to be known and exemplary of the U.S. prior art is the following:

3,353,825 Bach

The patent to Bach is distinguished by showing merely a ball having segments with apparent differing densities. The patent or known prior uses teach and disclose various types of bowling balls of sorts and of various manufactures and the like as well as methods of their construction, but none of them whether taken singly or in combination disclose the specific details of the combination of the invention in such a way as to bear upon the claims of the present invention.

SUMMARY OF THE INVENTION

An object of the present invention is to provide for increasing ball control in hooking, requiring less hook while having a much higher probability of striking due to improved penetration of the #1–#3 pocket.

Another object of the invention is to provide a ball of a thin, durable and hard shell preferably of urethane for surrounding a much softer inner core. The core is softer than the outer surface or may be softer than the material of the pins. A further hard inner core may be incorporated within the soft intermediate material.

The diameter of a conventional bowling ball specified by the ABC (American Bowling Congress) and PBA (Professional Bowlers Association) as having a diameter of between 8.500 and 8.595 inches, is too large to penetrate the "11∝3 pocket" required for attaining a reliable and repeatable "perfect strike" orderly lay-down of the ten (10) pins. Instead, the present-day ball knocks down either or both of the #1 and #3 pins, assuming a right-hand bowler throughout, at angles of 10° to 20° to the center line of the lane, rather than both outwardly at 30° as required for the perfect strike. A tolerance factor of about plus or minus 11° to the 30° optimum is allowable, due to off-ideal pin scattering. If the ball were smaller, actually about only 4 inches diameter, it could penetrate the pocket to knock both #1 and #3 outwardly at the optimum 30° angle to obtain a perfect strike. That perfect strike involves the ball striking pins #1, #3, #5 and #9 in succession, where pin #1→#→2→#4→#7, then #3→#6→#10, then #5→#8, and finally the ball hits #9 to complete the sequence. This ideal must be "approximated", e.g. by bouncing off the side kickboards, and/or the like, frequently by any high scoring bowler, e.g., about 50% of first balls to average about 200 score. Thus a smaller hit-effective ball radius, ideally by about 2 to 2.5 inches, enables a perfect strike with considerable tolerance of about 2 or 3 inches total in throwing accuracy from the "target center" of the pocket, when is about 3½ inches right or left of the #1 pin and lane center line.

This novel small-effective-radius ball is an alternative to contemporary "friction" or "hooking" balls, which achieve partial penetration of the pocket by approaching the #1 pin at a steep angle to the center line, required to be about 10° to strike #1 and #3 both at a plus or minus 30° angle to the center line. Unfortunately, the #9 pin would not be hit in this case, even if it were achieved in practice. Alas, it is not. Only about 5° or 6° is possible with today's lane geometry, oiling conditions, ball shell materials, and bowler strength and skill.

A detailed calculation, supported by extensive measurements and actual pinfalls, reveals that about ¼ inch of ball deformation by pin impact is equivalent to 1° hooking angle. Thus a 1 inch deformation would permit a perfect strike at about 6°, just marginally possible with contemporary materials and lane conditions, while a 1½ inch deformation would make a 4° approach sufficient. A 2 inch deformation would broaden the target width to 2 inches lateral error toleration at zero-degree (0°) approach. The comparable tolerance of a conventional ball at 0° from parallel to the center line is less than 0.5 inch. Thus the strike probability for a given level of bowler skill, i.e. accuracy, may be increased significantly, as much as four-fold for low levels of skill, by the use of the deformable ball.

To understand and describe the new ball concept, it is necessary to emphasize that conventional balls are much harder than the pins, which are typically made of laminated maple material or plastics of comparable modulus of elasticity E. In consequence, the pin deforms upon impact by a conventional ball by about ⅛ inch depth in a foot print of only about 1 square inch for a 16 pound ball, the maximum specified weight, at a speed of about 17 feet per second, typically encountered in league-level bowling. The situation is reversed with the novel deformation ball in which the ball deforms significantly while the pin does not.

An object, advantage and feature of the invention is to provide a novel and improved bowling ball constructed of material characterized as being grossly softer than the materials forming the pins.

Another object of the invention is directed further to a bowling ball having an elastomeric interior, constructed of either generally high or low dissipation material.

Another object of the invention is to provide a novel and improved method of selectively making a bowling ball having elastomeric interiors for the bowling ball and the method of its construction. The ball has a thin, hard, durable and deformable outer shell and may further have finger hole liners. The bowling ball of the invention has elastomeric interior of either high or low dissipation material, a thin, hard, durable and deformable outer shell and that may further include hole liners. The construction may provide according to the invention deformation by pin impacts, not possible with today's balls.

These together with other objects and advantages which will become subsequently apparent reside in the details of the process and operation thereof as more fully hereinafter is described and claimed, reference being had to the accompanying drawings forming a part hereof, wherein like numerals refer to like parts throughout.

DESCRIPTION OF THE SEVERAL VIEWS OF THE DRAWINGS

FIG. 1 is a sectional view of a two element or piece bowling ball in which an inner core is of soft elastomeric material softer than the hardness of the materials of the pins and is covered by a harder material and illustrating a typical installation of the ball according to a preferred embodiment and best mode of the present invention.

FIG. 2 is a sectional view of a three piece bowling ball and embodying concepts of the invention.

FIG. 3 is a sectional view of ball having a finger hold insertion firmly and securably attached to the outer shell and embodying concepts of the invention.

DESCRIPTION OF A PREFERRED EMBODIMENT OF THE INVENTION

Referring now to the drawings there is shown in FIG. 1 the preferred embodiment of the invention consisting of a two piece bowling ball 10 constructed of an outer surface or shell 12 for the ball 10, the outer shell 12 being constructed of conventional materials, preferably a urethane polymer, which has a weight typically in the range of 75 pounds per cubic foot. The thin durable shell 12 surrounds a much softer central or inner core 14 having an elasticity that is higher for providing increased momentum transfer and reactant pin action. The inner core 14 preferably has an elasticity greater than the pin's elasticity for providing high restitution and more "pin action" at all hook angles.

FIG. 2 shows an embodiment of a ball 20 with an outer shell 22 and inner core 24 further having a uniquely included hard inner core 26 and that is a further embodiment of the invention. The construction of the ball 20 is seen as encompassing characteristics that provide for requiring less hook while having a much higher probability of striking the pin (not shown) due to improved penetration of the #1–#3 pocket.

Improved penetration of the pins is thus achieved by making the ball's interior material 14, 24 sufficiently soft enough to be significantly deformable by the pin collision. The ball 10, 20 thereby has a smaller effective radius and is able to fit between the #1 and #3 pins, knocking each away at about 30°. In addition the deformed ball of the invention seems to enfold and engage the pin, thereby imparting to the pin its rolling and spinning motion to increase pin yawing. This results in a higher collision cross-section for #1 and #3 pins on contact with subsequent pins in the "chain" of collisions.

The deformable ball 10, 20, 30 consists of the hard deformable shell 12, 22 enclosing the soft elastomeric material 14, 24, lying typically about 200 times or more lower in modulus E than side-grain maple or equivalent hard plastics now in some use within pins, preferably in the range of about $10^4$ psi or less. For reasons of easy handling and throwing, efficient and controllable rolling down the lane, desirable lane-friction characteristics, and compliance with ABC and PBA surface hardness specifications of Durometer "D" 72 and "D" 75, respectively, the soft material must be enclosed in a hard shell, thin enough to deform without creasing or fatigue failure with a reasonable ball lifetime, yet thick enough to satisfy the previous requirements for practical use and specifications. The preferred shell thickness is in the range of 0.04 to 0.15 inches, depending upon specific design choices of the shell material, preferably a durable polymer such as urethane, and corresponding interior elastomer, especially as to its modulus E.

The interface bonding between the hard shell and soft interior is critical to durability against separation and/or delamination. Abrupt changes of material properties cause concentration of stress, in this case both shear and tension, during and immediately after impact. Gradual transition, or "grading," of the physical properties away from the interface over a thickness of greater than 0.01 inch lowers the stress to the range of cohesion and adhesion possible with currently available materials. An elastic adhesive layer is preferably used where a natural adhesion fails to exist between the shell and interior materials.

A cost savings is possible by the use of a three piece construction of FIG. 2, where a hard central core 26 of conventional ball material is used to replace some of the soft, deformable elastomer. Preferably this inner core 26 is smaller than 4 inch diameter, in order that optimal performance may be achieved by way of ball deformation.

Balls 10, 20, 30 are typically drilled for desired balance and for finger and thumb holes used in the throwing action. With the novel deformable ball of the invention shown in FIG. 3 holes are preferably drilled oversize and subsequently fitted with hole liners 38 of flexible liner material 40 in order to protect the integrity of the ball 10, 20, 30, especially against delamination. The liner material 40 must be secured firmly to the shell and have elastic properties between the extremes of the hard shell and soft interior, and also present firm exposed surface to the user's fingers and thumb, as is shown in FIG. 3.

A range of internal dissipation or "restitution" properties is possible within the design envelope of the novel ball. Preferably, the interior elastomer is highly elastic, with low dissipation and high restitution on the time-scale or the ball-pin collision, so that the ball quickly recovers its spherical shape upon separating from the pin. This permits steady, predictable rolling between pin impacts and also imparts a maximum of momentum transfer from ball to pins, resulting in greater "pin action" and generally higher scoring as a result.

An alternative, and less preferred, ball construction concept involves high dissipation, thus low coefficient of restitution (COR) to lower the approach angle required for a perfect strike, given a fixed level of ball properties. This is not found with conventional balls, since they are harder than the pins and deform only a negligible amount. The novel ball of the invention is seen to reverse this effect.

Scorability and performance of the deformable ball is seen to be enhanced by production of a side effect that is described as pin "yawing" especially the yawing of the #1, #3 and #5 pins struck directly by the ball. Yaw is generated by the rolling in the down lane direction and spinning about the vertical axis of the ball, which motion is transferred to the pins not only by the mechanics of ball-pin friction as with a conventional ball, but also by the much more effective "gearing" of the ball and pin together due to ball deformation by the pin.

In effect, the ball envelops the pin, then twists it into a yawing or tipping motion. This lateral tipping at high angular velocity, approaching 50 radians per second, results in the pins presenting a collision cross-section equal to their height, about 15 inches, rather than their maximum waist diameter of only about 4.77 inches. This "lying-over" effect increased pin action, especially in the way of a broadside "sweeping" by the #1, #3 and #5 pins.

Scorability of the deformable ball is further enhanced by a novel effect, unique to the properties of the ball of the invention. Because of the slight, but not negligible, flattening of the ball by its own weight on the lane surface, the novel ball effectively "hydroplanes" over the oily "conditioned" first section of the trajectory toward the pinset, then grabs the dry lane with greater friction as with raising slick tires) just before impact with #1 pin, resulting in more "hooking" of the trajectory and a higher possible angle-of-entry into the pinset "pocket". This desirable effect is even greater during any initial "bounce" portion of the ball trajectory just after ball release by the bowler. Just when the impact force or "impluse" is seen greatest, ball deformation increases to enhance the "hydroplaning" hence friction reduction with the lane, thereby further reducing lateral deflection and trajectory curvature where it is seen harmful to "hooking" and saving at the same time any lateral angular momentum of "English" for the terminal phase of the hooking path where it is most beneficial to achieving steep entry to the pocket, within the narrow constraint of the lane width.

A further feature of the deformable ball is its performance "tunability" or scorability control characteristics, by a mechanism of deflection control through the modulus E of the interior elastomer. Scorability may be thereby controlled in or by increments according to a "handicapping" schedule based on historical scoring average of an individual bowler, or other "fun" criteria. This in principle would "level the playing field" within a league, family or other convenient grouping, so that competition would be restored and/or close, based upon actual raw scores, without any subsequent adjustment or numerical handicapping. Each bowler in the group would be assigned a level-of-performance ball category based upon his scoring history in such a way that approximately equal scores to all members should result on average. Note also that a premium would accrue automatically for harder thrown, and faster balls, since deformation, hence scorability, increases with the ball momentum delivered at impact with the pins.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to falling within the scope of the invention.

What is claimed and desired to be secured by Letters Patent is:

1. A bowling ball comprising
on inner core of generally elastomeric material,
an outer shell of material generally surrounding throughout all the inner core, and
the generally elastomeric material generally consisting of material significantly more soft than the outer shell of hard surfaced material wherein the outer shell encompasses and forms an exterior of the inner core of the bowling ball and the characteristics of said core and shell are such that the ball assumes on effectively smaller ball radius on impact with a bowling pin to provide improved penetration of pinset "strike pocket" for higher scorability.

2. The apparatus of claim 1 wherein
the outer shell is essentially a thin outer shell for the bowling ball, and
the material is generally deformable an impact and essentially durable against creasing, yielding and fatigue on impact.

3. The apparatus of claim 1 wherein
the elastomeric material is generally softer than material forming the pin against which the ball impacts.

4. The apparatus of claim 1 wherein the outer shell of the ball is of urethane.

5. The apparatus of claim 1 wherein the thickness of the inner core is 4 inches.

6. The apparatus of claim 1 wherein the thickness of the inner core is less than 4 inches.

7. The apparatus of claim 1 wherein the thickness of the inner core is greater than 4 inches.

8. The apparatus of claim 1 wherein finger hole insertions are firmly and securely attached to the outer shell.

9. The apparatus of claim 1 wherein the ball possesses a thickness of the outer shell in the range of 0.04 to 0.15 inches.

* * * * *